US006508645B1

(12) United States Patent
George

(10) Patent No.: US 6,508,645 B1
(45) Date of Patent: Jan. 21, 2003

(54) MANIFOLD DIFFUSER ASSEMBLY FOR A GAS BURNER

(75) Inventor: Kenneth R. George, Parsons, KS (US)

(73) Assignee: Power Flame Incorporated, Parsons, KS (US)

( * ) Notice: Subject to any disclaimer, the term of this patent is extended or adjusted under 35 U.S.C. 154(b) by 0 days.

(21) Appl. No.: 09/939,779

(22) Filed: Aug. 28, 2001

(51) Int. Cl.[7] ..... F23Q 3/00

(52) U.S. Cl. ..... 431/266; 431/278; 431/284; 431/187

(58) Field of Search ..... 431/266, 265, 431/264, 187, 278, 284, 181, 186; 239/406, 434

(56) References Cited

U.S. PATENT DOCUMENTS

| | | | | |
|---|---|---|---|---|
| 2,911,035 A | | 11/1959 | Nieman et al. | |
| 3,265,114 A | | 8/1966 | Childree | |
| 3,273,621 A | | 9/1966 | Childree | |
| 3,542,500 A | * | 11/1970 | Norcross | 431/278 |
| 4,024,412 A | | 5/1977 | MacAskill, Jr. | |
| 4,140,476 A | | 2/1979 | Kaplan | |
| 4,222,089 A | | 9/1980 | MacAskill, Jr. et al. | |
| 4,373,901 A | | 2/1983 | Kaplan | |
| 4,388,064 A | | 6/1983 | Kaplan et al. | |
| 4,610,625 A | | 9/1986 | Bunn | |
| 4,701,123 A | | 10/1987 | Tallman et al. | |
| 4,968,246 A | | 11/1990 | Sasada et al. | |
| 5,098,282 A | | 3/1992 | Schwartz et al. | |
| 5,174,743 A | | 12/1992 | Wellman et al. | |
| 5,257,927 A | | 11/1993 | Lang | |
| 5,344,307 A | | 9/1994 | Schwartz et al. | |
| 5,542,840 A | | 8/1996 | Surbey et al. | |
| 5,649,819 A | | 7/1997 | Karzone | |
| 5,839,891 A | | 11/1998 | Cook | |
| 5,934,896 A | * | 8/1999 | Kwiatek | 431/266 |
| 5,957,682 A | | 9/1999 | Kamal | |
| 6,059,566 A | * | 5/2000 | Cummings, III | 431/266 |

FOREIGN PATENT DOCUMENTS

| | | |
|---|---|---|
| EP | 0485645 | 11/1990 |
| EP | 0552135 | 1/1993 |
| GB | 2223302 | 4/1990 |
| GB | 2233444 | 1/1991 |

* cited by examiner

*Primary Examiner*—James C. Yeung
(74) *Attorney, Agent, or Firm*—Roylance, Abrams, Berdo & Goodman, L.L.P.

(57) ABSTRACT

A burner head for a gas burner for improved flame stability and burner turndown is positioned in a longitudinally extending blast tube with an open end. The burner head includes a first surface facing in a direction transverse to the longitudinally extending blast tube and toward the open end, a second surface facing a direction transverse to the longitudinally extending blast tube and away from the open end and a third surface extending between the first and second surfaces. A first plurality of gas ports extends through the third surface, and a first passageway extends from the first surface to the second surface and is adapted to allow air to pass therethrough. A flame rod extends through the first passageway and into the flame zone.

24 Claims, 6 Drawing Sheets

18
18

MANIFOLD DIFFUSER ASSEMBLY FOR A GAS BURNER

FIELD OF THE INVENTION

The present invention relates to a manifold for a gas burner that improves flame stability and burner turndown. More specifically, the present invention relates to a manifold for a gas burner that introduces gas perpendicularly to the airflow at a point of highest air velocity and lowest static pressure for improved mixing and also introduces gas axially near the center of the manifold to improve flame stability and burner turndown.

BACKGROUND OF THE INVENTION

Conventional gas burners for use in furnaces, boilers, water heaters or other gas appliances mix gas, e.g., natural or LP gas, with air received from a fan or blower to form a mixture that is fed to a combustion head and ignited to form a flame along or adjacent to the combustion head. Generally, gas burners use a motor driven air blower to provide some or all of the air needed for combustion. Conventional gas burners have suffered from various drawbacks, which those in the art have sought to overcome. For example, some prior art burners do not completely combust all of the gas supplied to the burner. That is, although the gas and air mix sufficiently to ignite and produce a flame, some of the gas remains unburned and is vented along with the combustion products. This wastes gas and increases the cost of obtaining sufficient heat needed to operate the appliance with which the burner is utilized.

In addition, the goal of obtaining good mixing of the gas and air has led some in the art to increase the length of the combustion head or burner to increase the time during which the flowing gas and air may mix. In conventional burners, the length of the mixing chamber, as defined between the location at which the gas is emitted into the burner and the location at which the gas and air are substantially thoroughly mixed for combustion, can be as much as ten times as large as the diameter of the mixing chamber. Consequently, the manufacture of burners require a considerable amount of material which increases their size and cost. The increased size can present problems by limiting flexibility in utilizing the burner with various gas appliances.

Conventional gas burner designs also have attempted to produce an even, stable flame at the burner head, a desirable but often difficult feature to obtain. Prior art burners have included various devices to produce a stable flame that does not vary significantly along the length or around the burner head. For example, some burners have been provided with special inserts, e.g., cone-shaped orifice liner elements, in the burner to manipulate the flow of gas and air to obtain a relatively even flame profile. Including special inserts in the burners makes their manufacture more involved and costly.

Accordingly, a need exists for a gas burner that can produce an even, stable flame and is cost effective to make and operate.

SUMMARY OF THE INVENTION

Accordingly, it is an object of the present invention is to provide a burner with improved flame stability and burner turndown.

Another object of the present invention is to provide a burner that optimizes mixing of gas and air.

Still another object of the present invention is to provide a burner that optimizes mixing of gas and air by introducing gas perpendicularly to the airflow at a point of highest air velocity and static pressure.

Still another object of the present invention is to provide a burner that is cost effective to make and operate.

Yet another object of the present invention is to provide a burner that is versatile and can be used with various gas appliances.

The foregoing objects are basically obtained by providing a gas burner having a longitudinally extending blast tube with an open end and a burner head. The burner head includes a first surface that faces in a direction transverse to the longitudinally extending blast tube and toward the open end and a second surface that faces in a direction transverse to the longitudinally extending blast tube and away from the open end. A third surface extends between the first and second surfaces, with a first plurality of gas ports extending therethrough. A first passageway extends from the first surface to the second surface and is adapted to allow air to pass therethrough, and has a flame rod extending therethrough.

The foregoing objects are further provided by a diffuser assembly for a burner, including a first plate having a first opening and a first plurality of apertures adjacent the opening, the apertures adapted to allow gas to flow therethrough in an axial direction. A second plate is spaced from and oriented substantially parallel to the first plate and has a second opening. A radial surface extends between the first and second surfaces and has a second plurality of apertures, the second plurality of apertures adapted to allow gas to flow therethrough in a transverse direction relative to the first and second circular plates. A passageway extends between the first and second openings, the passageway adapted to allow air to pass therethrough, and has a flame rod extending therethrough.

The foregoing objects are further provided by a burner having improved stability control and turndown, including a blast tube having a first end and a second end. A fan is coupled to the blast tube, and adapted to drive air along the blast tube from the second end to the first end. A diffuser assembly is positioned within said blast tube and has a first circular plate, a second circular plate and a radial surface. The first circular plate faces in a direction of the blast tube first end and has a first plurality of gas ports extending therethrough and a first opening. The first plurality of gas ports is adapted to allow gas to flow therethrough in an axial direction. The second end faces in a direction of the blast tube second end and has a second opening. The radial surface extends between the first and second circular surfaces and has a second plurality of gas ports extending therethrough. The second plurality of gas ports is adapted to allow gas to flow therethrough in a radial direction. A passage extends between the first and second openings and is adapted to allow to air to pass therethrough, and has a flame rod extend therethrough.

Other objects, advantages, and salient features of the present invention will become apparent to those skilled in the art from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
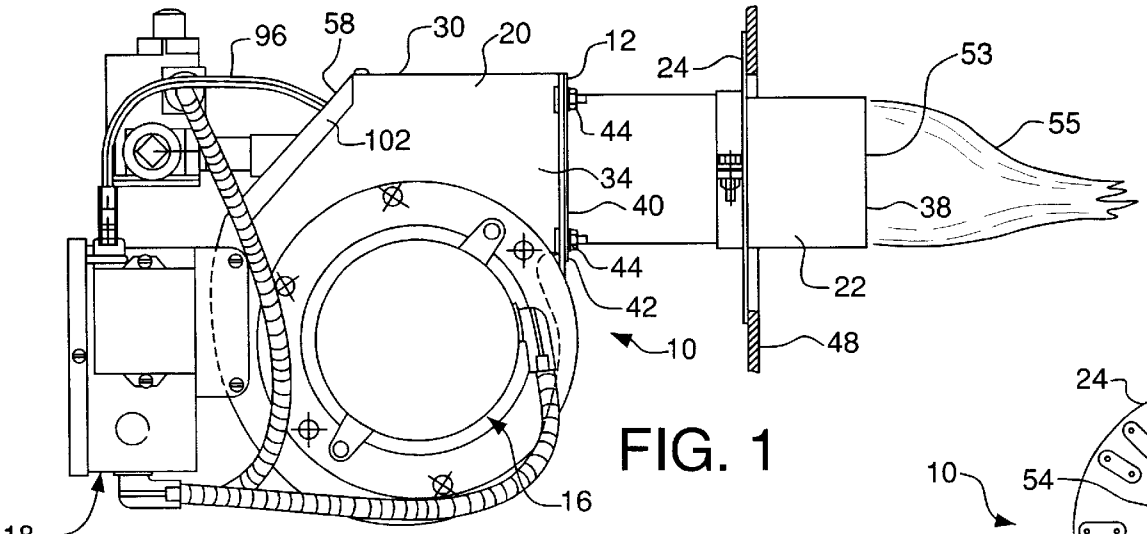
FIG. 1 is a side elevational view of the right side of a gas burner according to the preferred embodiment of the present invention.
Figure 3:
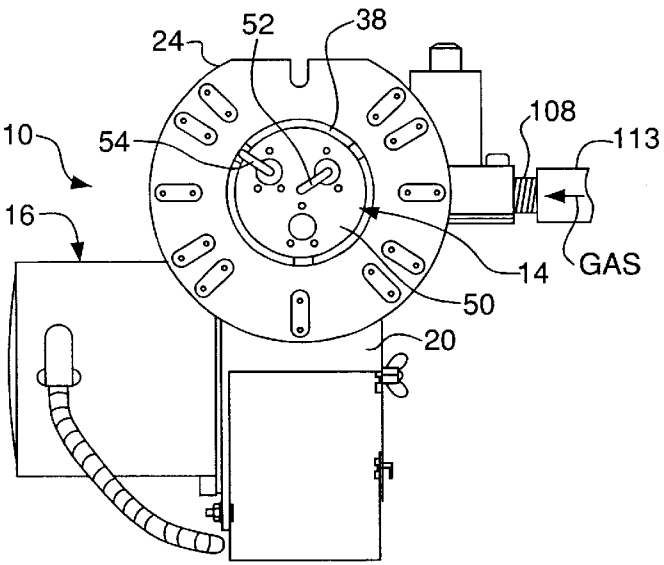
FIG. 3 is a front elevational view of the gas burner of FIG. 1.
Figure 2:
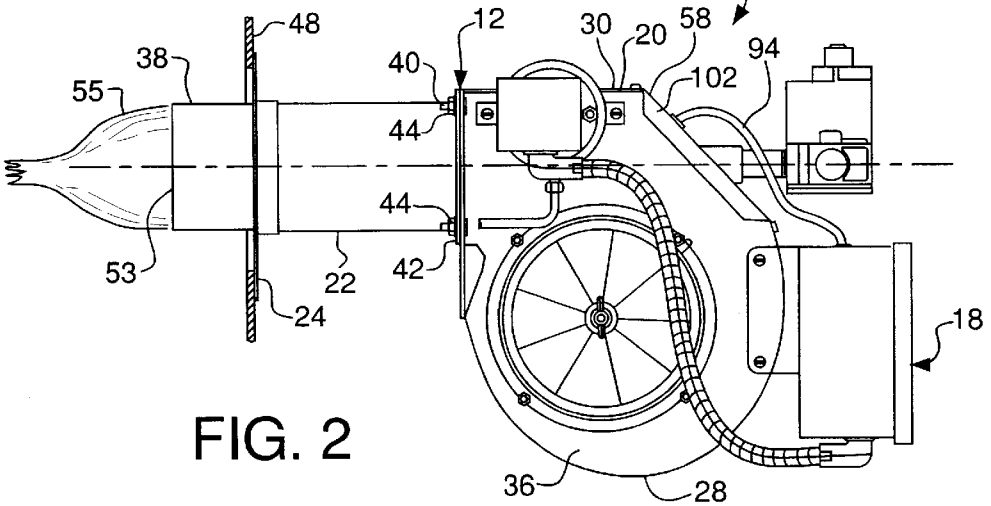
FIG. 2 is a side elevational view of the left side of the gas burner of FIG. 1.

As seen in FIGS. 1–4, a gas burner 10 in accordance with the present invention is illustrated and includes burner housing 12, burner assembly 14 positioned within housing 12, and a fan motor 16 and control box 18 coupled to housing 12.

Housing 12 is preferably a metal housing having a blower housing 20, a blast tube assembly 22 and mounting flange 24. Blower housing 20 houses fan or blower 26, as seen specifically in FIG. 4, and directs the flow of air into blast tube assembly 22. Blower housing 20 is preferably substantially arcuate or curved at a bottom portion 28 and substantially planar or flat along a portion 30, with an access opening 32 for positioning burner assembly 14. Housing 12 has first and second sides 34 and 36, respectively, which are substantially parallel to each other and substantially perpendicular to portion 30. The curved portion 28 allows the air being pushed by fan 26 to be fed into the blast tube assembly 22 for greater efficiency of the burner assembly 14.

Blast tube assembly 22 is preferably a 4 inch metallic, substantially cylindrical tube having open first and second ends 38 and 40. A mounting bracket 42 is unitary with the second end of the tube assembly and allows the tube assembly to be coupled with housing 12, using bolts 44 or any fastening devices or means known in the art.

Mounting flange 24 is preferably a substantially ring-shaped metal bracket that fits around tube assembly 22 and is coupled thereto by bracket 46. Mounting flange 24 and flange gasket 25 couple the tube assembly 22 to the side wall 48 of a boiler. Furthermore, flange 24 may be positioned anywhere along tube assembly 22, so that the open end 38 can be properly positioned within the boiler. For example, it may be necessary to position the open end 38 of the tube assembly closer or farther from the center of the boiler, depending on the desired performance.

Figure 5:
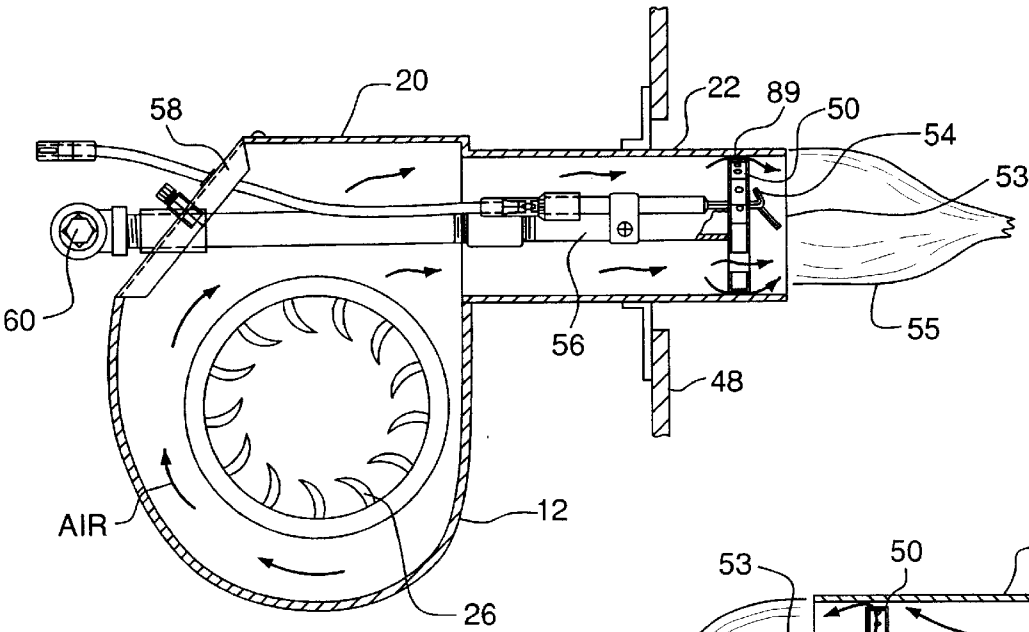
FIG. 5 is a side view in section of the burner housing and burner assembly of FIG. 1.
Figure 6:
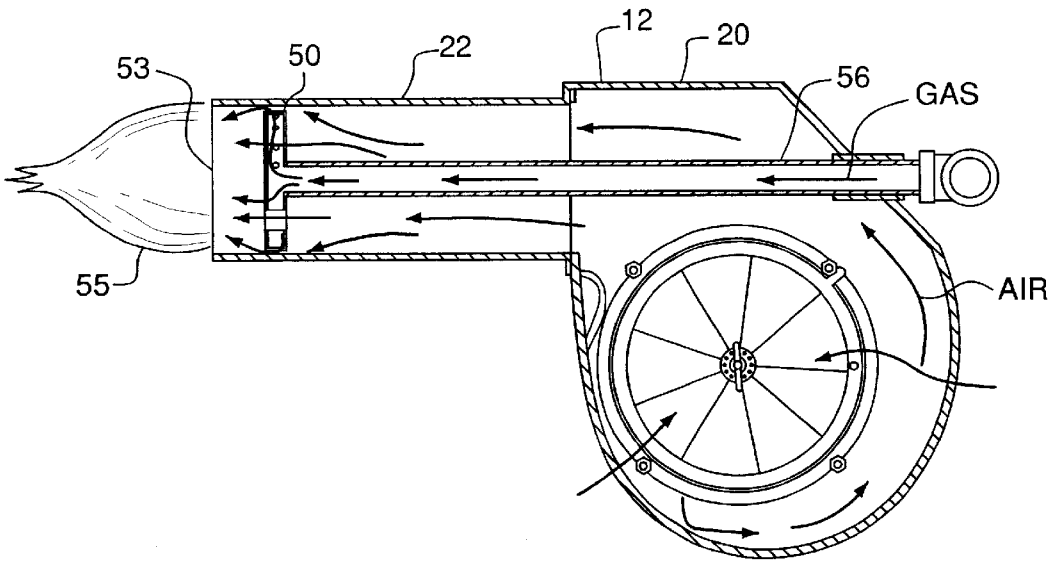
FIG. 6 is cross sectional side view of the burner housing, burner head of the gas burner of FIG. 1, illustrating a preferred flow of air through the blast tube assembly.
Figure 10:
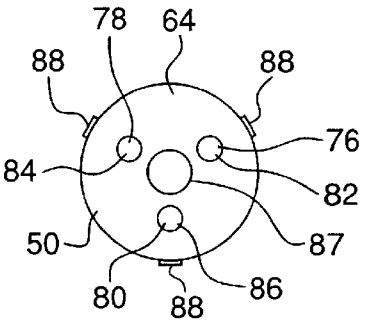
FIG. 10 is an elevational view of the rear surface of the burner head of FIG. 1.

Burner assembly 14 includes a gun head 50, a flame rod 52, an ignition electrode 54, a center gas supply pipe 56, a backing plate 58 and a side orifice tee 60. As seen in FIGS. 5 and 6, the burner assembly is positioned within the blast tube assembly 22 and the upper portion of the blower housing 20.

As seen in FIGS. 7–10, the gun head 50 has a first or front plate or surface 62 and a second or rear plate or surface 64 that are substantially circular and connected by a third surface or strip 66. The front and rear surfaces are oriented substantially parallel to one another and have substantially the same diameter, which is about 3 ½ inches. Each surface 62 and 64 faces in a direction transverse to the longitudinal extending blast tube and surface 62 faces toward end 38 and second surface 64 faces toward end 40. The third surface 66 is preferably about ½ inch in width and is welded to and extends about the entire perimeter of each surface 62 and 64. Furthermore, surface 66 extends at a substantially perpendicular angle from each surface 62 and 64, encloses an internal area therein and is coupled to each surface using any conventional method such as welding.

Surface 62 is preferably substantially planar and metallic and has three holes or apertures 68, 70 and 72 therethrough. Holes 68, 70 and 72 are equally spaced about the center of surface 62. In other words, each hole is equidistant, respective to each other hole, from the center of the surface 62 and equidistant from each other, so that if the holes were connected they would form an equilateral triangle having a center that coincides with the center of surface 62. Furthermore, each hole 68, 70 and 72 has at least three gas ports 74 equally spaced thereabout, in the same manner as described for holes 68, 70 and 72. In other words, each group of three gas ports is positioned so that each gas port is equidistant, with respect to the other two gas ports, from the center of the respective hole, and each gas port is also equidistant from the other two gas ports in a respective group of three.

Surface 64 is preferably substantially planar and metallic and has three holes 76, 78 and 80 extending therethrough. Holes 76, 78 and 80 are positioned in the same manner as holes 68, 70 and 72, and preferably the distance from the center of surface 64 to each hole 76, 78 and 80 is substantially the same distance as the distance from the center of surface 62 to holes 68, 70 and 72. Therefore, when the two plates are aligned and coupled together, holes 68 and 76, 70 and holes 78 and 72 and 80 are respectively aligned, forming three through preferably ½ inch diameter passageways 82, 84 and 86 that extend from first surface 62 to second surface 64 and entirely through the burner head. However, there can be any number of passageways desired and they can be any suitable size and shape. Each passageway is surrounded by a metal surface or cover that is flush with both surfaces 62 and 64, so that access through the burner head can be achieved without access into the interior of the burner head. Additionally, second surface 64 has an aperture or hole 87 that extends therethrough. Furthermore, second surface 64 preferably has three tabs 88 coupled thereto, in any manner desired, such as welding or being unitary therewith. Each tab is positioned around the perimeter of surface 64 proximate to a hole 76, 78 or 80, and extends radially outwardly and equidistant from each other adjacent tab. In other words, each tab is aligned radially with respect to the center of surface 64.

Surface 66 is preferably a metal strip and has a plurality of gas ports or apertures 89 extending therethrough. Preferably, ports 89 number at least 15 and are evenly spaced around surface 66. Ports 89 allow access to the interior of the burner head. When surfaces 62, 64 and 66 are coupled together they create a hollow area into which gas can be fed.

Figure 7:
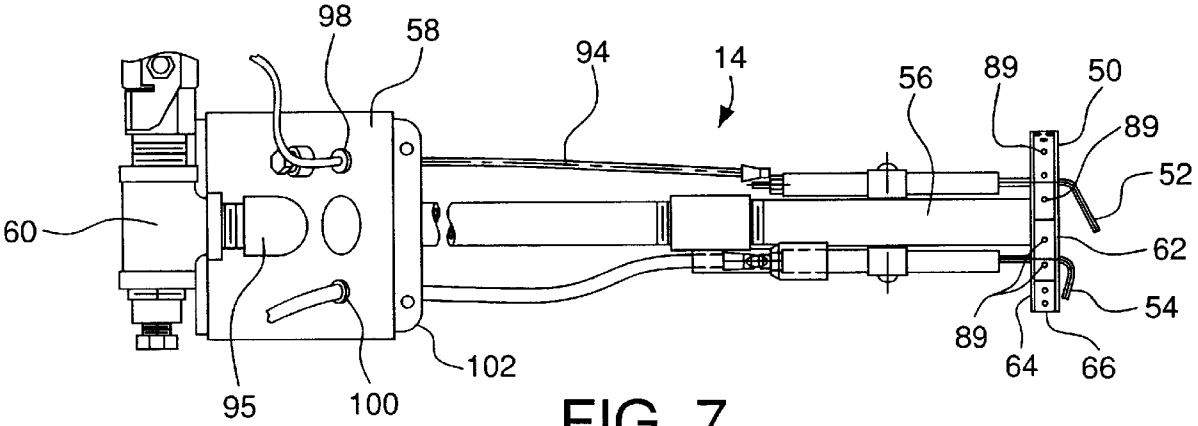
FIG. 7 is a top elevational view of the burner assembly for the gas burner of FIG. 1.
Figure 8:
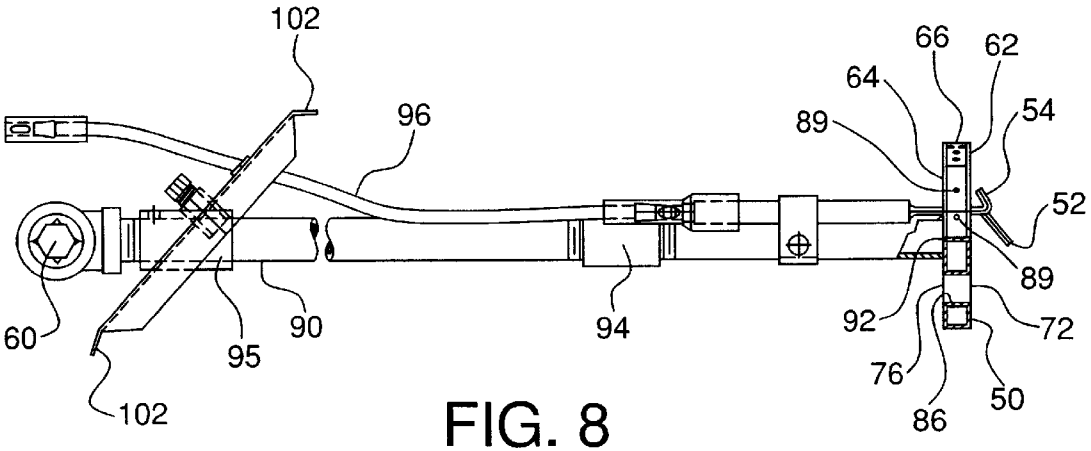
FIG. 8 is a side elevational view of the burner assembly of FIG. 7.

As seen in FIGS. 7 and 8, center gas supply tube 56 is preferably a hollow metal tube that has a first end 90 and a second end 92. However, assembly 56 does not need to be one tube and may be a series of tubes coupled together using a threaded joint 94. Second end 92 is preferably coupled to second surface 64 overlying opening 87. Second end 92 can be coupled to second surface 64 in any manner known in the art, such as welding. First end is preferably coupled to orifice tee 60 using a threaded joint 95, but can be coupled to tee 60 in any manner desired.

Flame rod 52 extends through passageway 82 defined in the burner head, or gun head 50, to sense the presence of a flame. As seen specifically in FIGS. 7–10, wire 94 for flame rod 52 extends from the control box 18 (FIG. 2) through plate 58 and couples to flame rod 52. Flame rod 52 then extends along and adjacent center gas supply tube 56 through second surface 64 into passageway 82 and through first surface 62, so that flame rod 52 is positioned in the flame zone 53. Flame rod 52 initially extends substantially parallel to center gas supply tube 56 and after it passes through passageway 42, it bends at an obtuse angle and extends toward the center of surface 62.

An ignition electrode 54 extends through passageway 84 defined in the burner head 50 to ignite the air/combustion gas mixture. As seen specifically in FIGS. 7–10, wire 96 for ignition electrode 54 extends from the control box 18 (FIG. 1) through plate 58 and couples to ignition electrode 56. Ignition electrode 56 then extends along and adjacent center gas supply tube 56 through second surface 64 into passageway 84 and through first surface 62, so that ignition electrode 54 is positioned in the flame zone 53. The ignition electrode initially extends substantially parallel to center gas supply tube 56 and after it passes through passageway 84 it bends at an acute angle and slightly toward surface 62. The ignition electrode substantially aligns flush with the edge of surface 62 and centered on the closest tab 88. Additionally, the tip of the ignition 54 forms about a ⅛" spark gap with surface 62.

Backing plate 58 is coupled to center gas supply tube 56 with openings 98 and 100 therein for allowing the wires for the flame rod 52 and the ignition electrode 84, respectively, to pass therethrough. Furthermore, plate 58 has angled or bent portions 102 that allow the backing plate and therefore the burner assembly to couple to the housing 12, as seen in FIG. 5. Preferably, backing plate 58 is a metallic, rectangular plate that can support the entire burner assembly. Plate 58 can be coupled to the housing in any manner desired, such as screws, welding, bolts or any other means known in the art.

Figure 4:
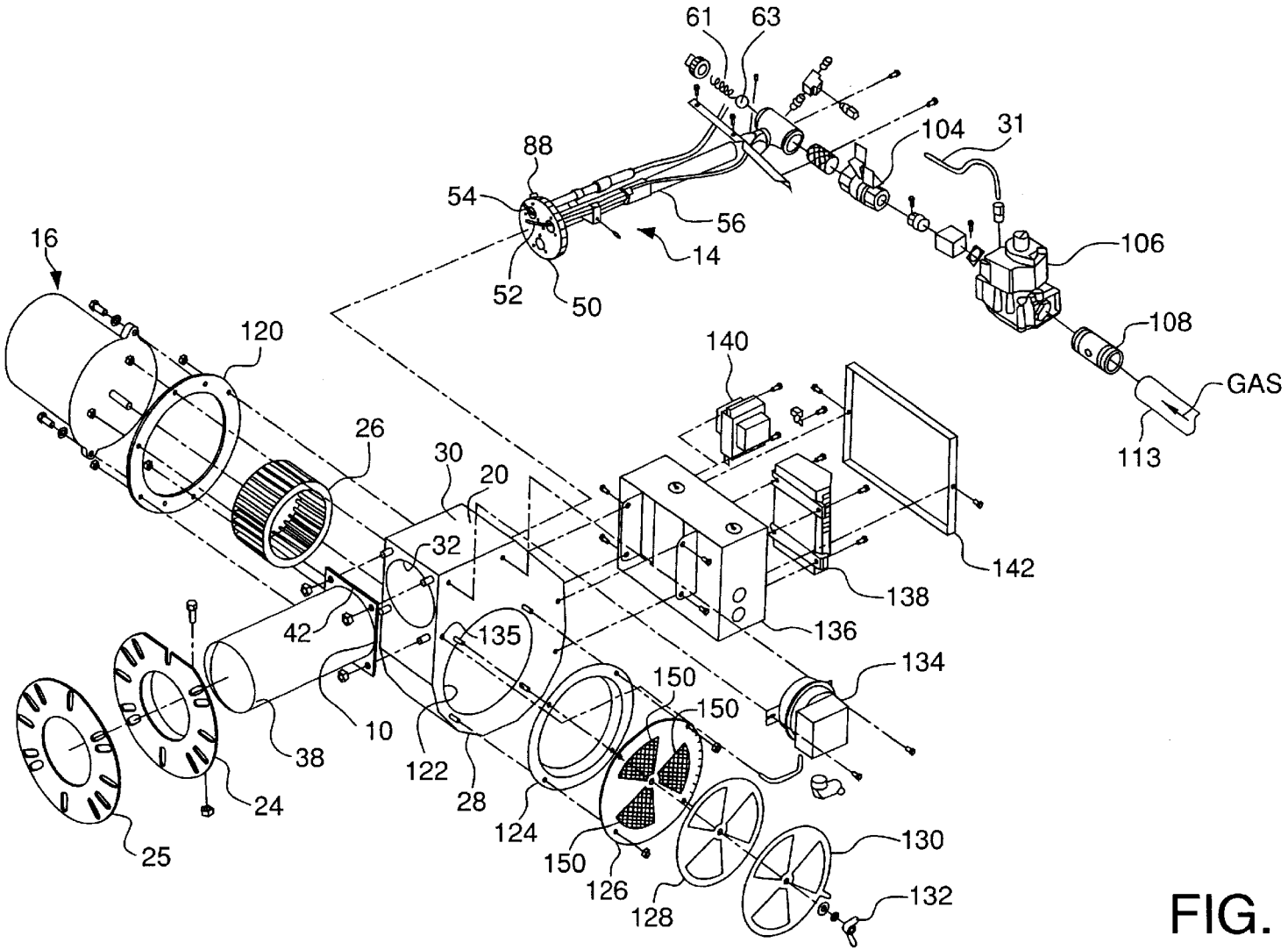
FIG. 4 is an exploded top perspective view of the gas burner of FIG. 1.

Orifice tee 60 is preferably threaded onto first end 90 of the center gas supply tube 56, but may be coupled thereto in any manner desired. As seen in FIG. 4, tee 60 is threaded or coupled to the leak test gas cock 104, which in turn is threaded to the combination gas valve 106. Furthermore, as seen in FIG. 4, side orifice spring 61 orifice 63 are inserted into orifice tee 60 for setting the rate of the burner, as is known in the art.

The gas valve 106 is a combination valve, or a regulation and an automatic shut off valve in one apparatus. The gas valve 106 has an inlet 105 and an outlet (not shown). A pipe 113 is coupled to the nipple 108 by a pipe union (not shown), which leads to a gas supply, as seen specifically in FIGS. 3 and 4. The union is generally used to ease service and installation.

Fan motor 16 is coupled to motor plate 120 and blower housing 20 using screws, bolts or any conventional means and drives blower wheel or fan 126, which is housed within blower housing 20. Fan motor 16 can be any conventional motor, such as a constant speed motor or a variable speed drive motor and can have any appropriate horsepower. Furthermore, opening 122 in blower housing 20 is covered by inlet ring 124 and inner damper 126, middle damper 128 and outer damper 130, which are coupled to the fan motor 16 by nut 132. Specifically, damper 126 is substantially circular and is coupled to housing side 36 and is aligned with or covers opening 122. As seen in FIG. 4, damper 126 has three mesh or filter areas 150 that are wedged-shaped and are substantially equal in area to each other. Dampers 128 and 130 are substantially similar and have three wedged openings 152 that are substantially equal in size and shape to mesh areas 150. By varying the rotational position of dampers 128 and 130, the amount of air introduced into the system can vary. This change in position can either be done manually or by computer control and depending on the amount of air desired to mix with the gas, the desired size and strength of the flame can be achieved. Furthermore, as discussed above, a variable speed drive can be used in conjunction with movable or static dampers to achieve the same result.

Air switch 134 is also coupled to blower housing 20 using screws or bolts and has an air sensing tube extending therefrom that enters housing 20 through opening or hole 135 and senses the pressure of air that passes thereby. Air switch 134 is also connected to control box 18, and provides proof of combustion air flow for safe start before the introduction of gas.

Control box 18 includes a substantially rectangular metal panel housing 136, a flame monitor 138, a 24 volt transformer 140 and a panel back 142. The flame monitor and transformer are enclosed in the panel housing and monitor the flame for flame presence as is known in the art. Manual control of the fuel and air is the preferred method, and this can be achieved by adjusting at least one of the three dampers 126, 128 and 130 to allow the proper amount of air to be input by the fan as described above. Furthermore, the gas can be controlled through the combination gas valve by varying it's outlet pressure or changing the main gas orifice.

Operation

As best seen in FIGS. 5–10, by forming the burner head 50 as described above, improved flame stability and burner turndown are possible. More specifically, gas is introduced through pipe 113 through inlet 105 of valve 106, where it exits the valve and enters the orifice tee 60. From the tee 60 it travels through the center of the assembly 56 and the manifold/diffuser or burner head 50. From the burner head about 60% of the gas is introduced radially through gas ports 89 (FIGS. 5 and 7) and about 40% of the gas is introduced axially through ports 74 (FIG. 9), which are located adjacent passageways 82, 84, and 86. Fan 26, as seen in FIGS. 5 and 6, introduces air through the inlet dampers and into the housing 20, where it is effectively converted from high velocity air into high static pressure when it enters the blast tube assembly 22. As the air reaches the burner head it reaches a higher velocity due to the reduced area and some air flows through passageways 82, 84 and 86, while a portion of the air flows around the burner head, as shown in FIG. 6.

The air that flows through passageways 82, 84 and 86 mixes with the gas from ports 74 and the air flowing around the burner head is separated into three zones by the three tabs 88 and mixes with the gas from ports 89 that is introduced perpendicularly to the air flow as seen in FIG. 6. The ignition electrode 54, shown in FIGS. 5 and 7–9, ignites the gas and air to produce the flame 55.

The gas that is introduced radially and mixes with air that flows around the burner head mixes at a point of highest air velocity and lowest static pressure, which allows increased mixing of the gas and air. Optimum mixing of gas and air occurs at lower manifold pressures. Furthermore, the three tabs 88 separate the air that flows around the burner head and create three well-mixed recirculation zones. A spark by the ignition electrode placed downstream of one of the recirculation zones achieves immediate and consistent ignition of the flame.

Figure 9:
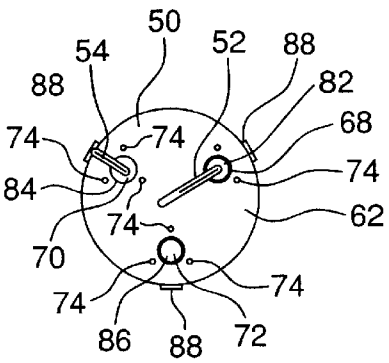
FIG. 9 is a front elevational view of the burner assembly of FIG. 7.

The gas that is introduced axially near the center of the burner head and surface 62, seen in FIG. 9, adjacent passageways 82, 84 and 86 produces three separate slower mixing diffusion flames. These separate flames greatly improve the flame stability and turndown of the burner. With proper air control the burner can achieve about a 5 to 1 turndown while maintaining stability and good mixing. Turndown is the ratio of the high fire rate to low fire rate. This burner has a maximum high fire rate of 725,000 btu and a low fire rate of 150,000 btu.

The overall design of this burner enables it to fire at "over fire" pressures exceeding 0.7" w.c. at over 500,000 btu input, which means the burner can fire at that rate against an opposing pressure inside the heat exchanger of 0.7" w.c.

Additionally, since the ignition electrode and the flame rod are inserted into the flame zone through passageways 82 and 84, respectively, the chances of shorting out, due to misalignment during installation and thermal changes during operation, are reduced.

Embodiment of FIGS. 11–17

As seen in FIGS. 11–17, a second embodiment for the burner system 210 of the present invention is shown which the ignition electrode 254 is positioned within the pilot assembly 256. In system 210, a fourth passageway 289 extends through openings 273 and 281 in first and second surfaces 262 and 264 of burner head 250, respectively, and pilot assembly 256 extends through passageway 289 to expose second end 257 of pilot head 263 to the flame zone. First and second surfaces 262 and 264 have apertures 268, 270 and 272 and 276, 278 and 280, respectively, that are substantially similar to the apertures 68, 70 and 72 and 76, 78 and 80, described above.

Figure 11:
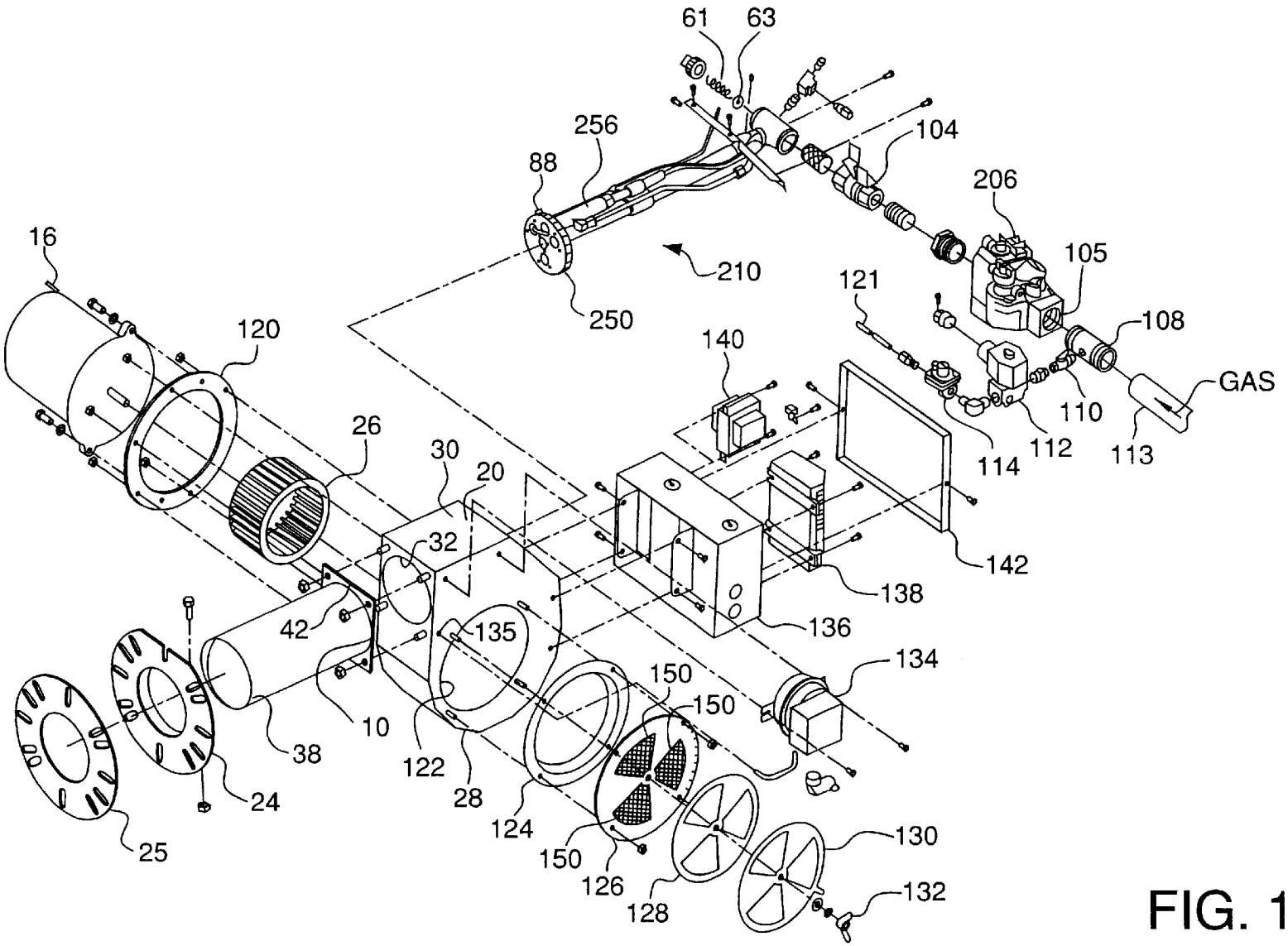
FIG. 11 is an exploded top perspective view of a second embodiment with pilot assembly for a burner assembly for the gas burner of FIG. 1.
Figures 12, 13, 14, 15, 16, 17, 18:
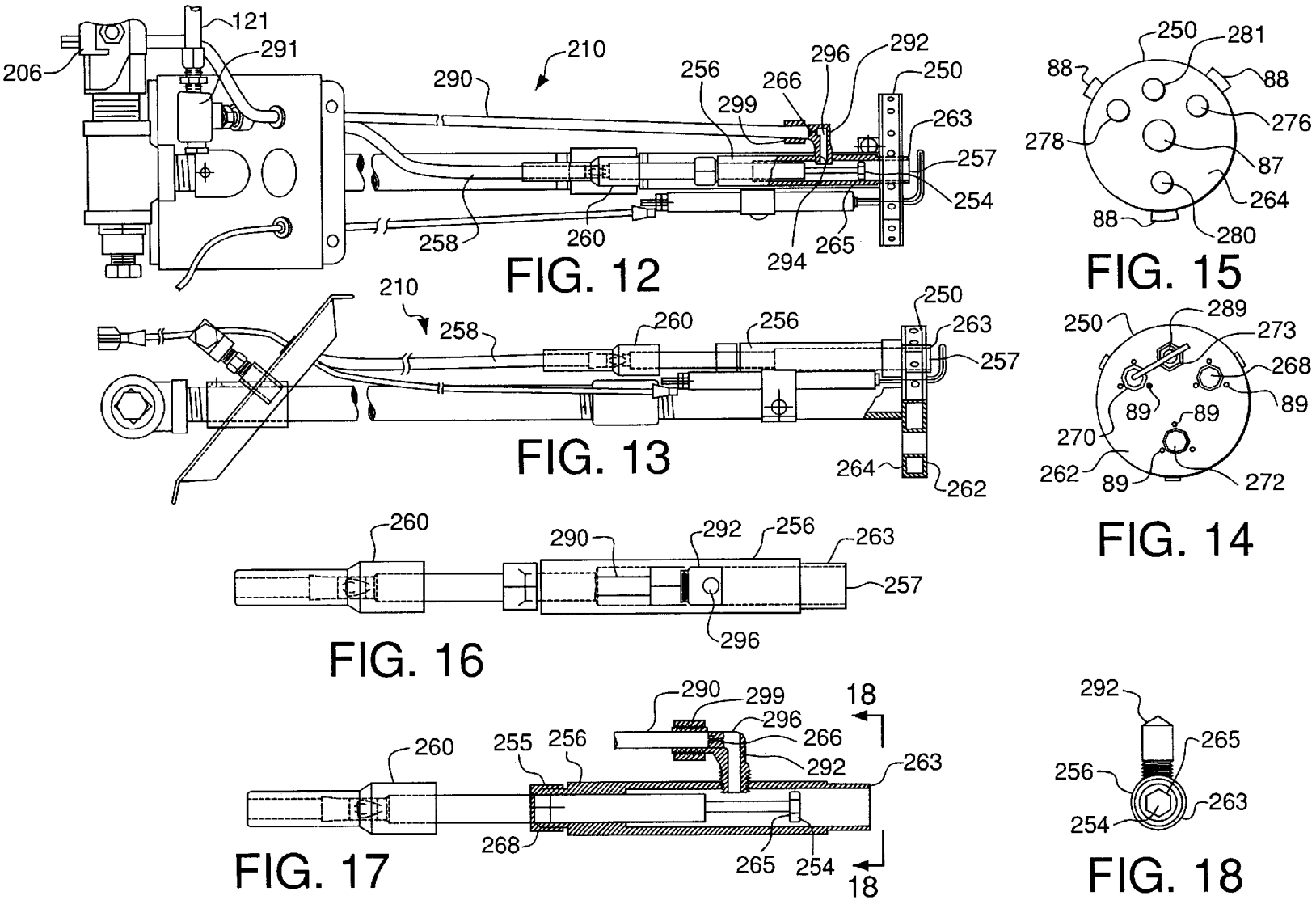
FIG. 12 is a top elevational view of the burner assembly of FIG. 11.
FIG. 13 is a side elevational view of the burner assembly of FIG. 11.
FIG. 14 is a front elevational view of the burner assembly of FIG. 11.
FIG. 15 is an elevational view of the rear surface of the burner head for the burner assembly of FIG. 11.
FIG. 16 is top elevational view of the pilot for the burner assembly of FIG. 11.
FIG. 17 is a side view in section of the pilot of FIG. 13.
FIG. 18 is a front view of the pilot of FIG. 14 taken along lines 15—15.

As seen in FIG. 11, gas valve 206 is substantially similar to valve 106. However, gas valve 206 is coupled to a tapped nipple 108 threaded into the inlet which is coupled to a pilot gas cock 110, a pilot valve 112, a pilot regulator 114.

Furthermore, system 210 preferably has an aluminum pipe 290 that extends from gas valve 206 to fixture 292 which is inserted into an aperture or port 294 in the pilot assembly 256. However, pipe 290 can be made from any material. Fixture 292 also has a air hole 298 that allows or sucks air into fixture 296 due to the vacuum caused by the gas flowing through the fixture, and that mixes the air with the gas that flows through gas orifice 266, the combined air and gas then flowing into the pilot assembly 256 where it is ignited by the ignition electrode 254. Fixture 292 threads into aperture 294 and is affixed to pipe 290 using threaded clamp 299.

As seen in FIGS. 11–15, pilot assembly 256 preferably includes a tube 258 that allows gas to be delivered to ignition electrode 254. Pilot line 121 (FIG. 11) couples to the pilot pressure port 291, which allows gas to flow through the tapped nipple 108, pilot gas cock 110, pilot valve 112, pilot regulator 114 and tube 258 and to the pilot assembly 256 before gas enters the combination valve. This ensures a quicker and easier start up. Rubber boot 260 couples to ignition cable 258 to ignition electrode 254 and prevents sparking to center gas supply tube. Ignition electrode 254 is inserted or positioned with pilot head 263 and the head 265 is centered therein, preferably about 1 inch from the second end 257 of the pilot head 263.

A ferrule 268 is clamped around first end 255 of pilot head 263 and holds or clamps the ignition electrode therein and prevents gas seepage. Preferably, ferrule 268 is nylon, but can be any material desired.

The operation of burner assembly 214 is substantially similar to the assembly 14 described above, except for the position of the ignition electrode. For example, gas flows through pipe 113 to valve 206 and into orifice tee 60. The gas then flows down pilot assembly 256 where it is ignited by ignition electrode 254.

Burner system 210 is similar to gas burner 10 and the above description and reference numerals of burner 10 are applicable to burner system 210 except where modified above.

While specific embodiments have been chosen to illustrate the present invention, it will be understood by these skilled in the art that various changes and modifications can be made therein without departing from the scope of the invention as defined in the appended claims.

What is claimed is:

1. A burner head for a gas burner having a longitudinally extending blast tube with an open end, comprising:

a first surface facing in a direction transverse to the longitudinally extending blast tube and toward an open end;

a second surface facing in a direction transverse to the longitudinally extending blast tube and away from the open end;

a third surface extending between said first and second surfaces;

a first plurality of gas ports extending through said third surface;

a first passageway extending from said first surface to said second surface and adapted to allow air to pass therethrough; and a flame rod extending through said first passageway.

2. A burner head according to claim 1, wherein said first surface is substantially circular and said second surface is substantially circular and oriented substantially parallel to said first surface.

3. A burner head according to claim 1, and further including a second plurality of gas ports extending through said first surface.

4. A burner head according to claim 3, and further including second and third passageways extending from said first surface to said second surface and adapted to allow air to pass therethrough.

5. A burner head according to claim 4, and further including an ignition electrode extending through at least one of said second and third passageways.

6. A burner head according to claim 4, wherein said second plurality of gas ports are adjacent said first, second and third passageways.

7. A burner head according to claim 6, wherein said first plurality of gas port are equally distributed around said first, second and third passageways.

8. A burner head according to claim 6, wherein said first plurality of gas ports includes nine gas ports, three of said nine gas ports evenly spaced around each of said first, second and third passageways.

9. A diffuser assembly for a burner, comprising:

a first surface having a first opening and a first plurality of apertures adjacent said opening, said apertures adapted to allow gas to flow therethrough in an axial direction;

a second surface spaced from and oriented substantially parallel to said first plate and having a second opening;

a radial surface extending between said first and second surfaces and having a second plurality of apertures, said second plurality of apertures adapted to allow gas to flow therethrough in a transverse direction relative to said first and second circular plates;

a passageway extending between said first and second openings, said passageway adapted to allow air to pass therethrough; and a flame rod extending through said passageway.

10. A diffuser assembly according to claim 9, and further including second and third passageways extending from said first surface to said second surface and adapted to allow air to pass therethrough.

11. A diffuser assembly according to claim 10, and further including an ignition electrode extending through at least one of said second and third passageways.

12. A diffuser assembly according to claim 10, wherein said first plurality of gas ports are adjacent said first, second and third passageways.

13. A diffuser assembly according to claim 12, wherein said first plurality of gas ports are equally distributed around said first, second and third passageways.

14. A diffuser assembly according to claim 12, wherein said first plurality of gas ports includes nine gas ports, three of said nine gas ports evenly spaced around each of said first, second and third passageways.

15. A burner having improved stability control and turndown, comprising:

a blast tube having a first end and a second end;

a fan coupled to said blast tube, and adapted to drive air along said blast tube from said second end to said first end;

a diffuser assembly positioned within said blast tube and having a first circular plate, a second circular plate and a radial surface, said first circular plate facing in a direction of said blast tube first end and having a first plurality of gas ports extending therethrough and a first opening, said first plurality of gas ports adapted to allow gas to flow therethrough in an axial direction, said second end facing in a direction of said blast tube second end and having a second opening, and said radial surface extending between said first and second circular surfaces and having a second plurality of gas ports extending therethrough, said second plurality of gas ports adapted to allow gas to flow therethrough in a radial direction;

a passage extending between said first and second openings and adapted to allow to air to pass therethrough; and a flame rod extending through said passageway.

16. A burner according to claim 15, and further including second and third passageways extending from said first surface to said second surface and adapted to allow air to pass therethrough.

17. A burner according to claim 16, and further including an ignition electrode extending through at least one of said second and third passageways.

18. A burner head for a gas burner having a longitudinally extending blast tube with an open end, comprising:

a first surface facing in a direction transverse to the longitudinally extending blast tube and toward an open end;

a second surface facing in a direction transverse to the longitudinally extending blast tube and away from the open end;

a third surface extending between said first and second surfaces;

a first plurality of gas ports extending through said third surface;

a first passageway extending from said first surface to said second surface and adapted to allow air to pass therethrough;

a flame rod extending through said first passageway;

a second plurality of gas ports extending through said first surface;

second and third passageways extending from said first surface to said second surface and adapted to allow air to pass therethrough;

a fourth passageway extending from said first surface to said second surface;

a pilot head extending through said fourth passageway; and an ignition electrode positioned within said pilot head.

19. A burner head for a gas burner having a longitudinally extending blast tube with an open end, comprising:

a first surface facing in a direction transverse to the longitudinally extending blast tube and toward an open end;

a second surface facing in a direction transverse to the longitudinally extending blast tube and away from the open end, said second surface having first, second and third tabs extending outwardly therefrom;

a third surface extending between said first and second surfaces;

a first plurality of gas ports extending through said third surface;

a first passageway extending from said first surface to said second surface and adapted to allow air to pass therethrough; and a flame rod extending through said first passageway.

20. A burner head according to claim 19, wherein said first, second and third tabs are evenly spaced around said second surface.

21. A diffuser assembly for a burner, comprising:

a first plate having a first opening and a first plurality of apertures adjacent said opening, said apertures adapted to allow gas to flow therethrough in an axial direction;

a second plate spaced from and oriented substantially parallel to said first plate and having a second opening;

a radial surface extending between said first and second surfaces and having a second plurality of apertures, said second plurality of apertures adapted to allow gas to flow therethrough in a transverse direction relative to said first and second circular plates;

a passageway extending between said first and second openings, said passageway adapted to allow air to pass therethrough;

a flame rod extending through said passageway;

second and third passageways extending from said first surface to said second surface and adapted to allow air to pass therethrough;

a fourth passageway extending from said first surface through said second surface;

a pilot head extending through said fourth passageway; and an ignition electrode positioned within said pilot head.

22. A diffuser assembly for a burner, comprising:

a first surface having a first opening and a first plurality of apertures adjacent said opening, said apertures adapted to allow gas to flow therethrough in an axial direction;

a second surface spaced from and oriented substantially parallel to said first plate and having a second opening, said second surface having first, second and third tabs extending outwardly therefrom;

a radial surface extending between said first and second surfaces and having a second plurality of apertures, said second plurality of apertures adapted to allow gas to flow therethrough in a transverse direction relative to said first and second circular plates;

a passageway extending between said first and second openings, said passageway adapted to allow air to pass therethrough; and a flame rod extending through said passageway.

23. A diffuser assembly according to claim 22, wherein said first, second and third tabs are evenly spaced around said second surface.

24. A burner having improved stability control and turndown, comprising:

a blast tube having a first end and a second end;

a fan coupled to said blast tube, and adapted to drive air along said blast tube from said second end to said first end;

a diffuser assembly positioned within said blast tube and having a first circular plate, a second circular plate and a radial surface, said first circular plate facing in a direction of said blast tube first end and having a first plurality of gas ports extending therethrough and a first opening, said first plurality of gas ports adapted to allow gas to flow therethrough in an axial direction, said second end facing in a direction of said blast tube second end and having a second opening, and said radial surface extending between said first and second circular surfaces and having a second plurality of gas ports extending therethrough, said second plurality of gas ports adapted to allow gas to flow therethrough in a radial direction;

a passage extending between said first and second openings and adapted to allow to air to pass therethrough;

a flame rod extending through said passageway;

second and third passageways extending from said first surface to said second surface and adapted to allow air to pass therethrough;

a fourth passageway extending from said first surface through said second surface;

a pilot head extending through said fourth passageway; and an ignition electrode positioned within said pilot head.

* * * * *